US011820541B2

(12) United States Patent
Peterlini

(10) Patent No.: US 11,820,541 B2
(45) Date of Patent: Nov. 21, 2023

(54) DEVICE AND METHOD FOR COLLATING AND LOADING ARTICLES

(71) Applicant: Jacky Peterlini, Annecy-le-Vieux (FR)

(72) Inventor: Jacky Peterlini, Annecy-le-Vieux (FR)

( * ) Notice: Subject to any disclaimer, the term of this patent is extended or adjusted under 35 U.S.C. 154(b) by 112 days.

(21) Appl. No.: 17/285,843

(22) PCT Filed: Oct. 17, 2019

(86) PCT No.: PCT/EP2019/078292
§ 371 (c)(1),
(2) Date: Apr. 15, 2021

(87) PCT Pub. No.: WO2020/079192
PCT Pub. Date: Apr. 23, 2020

(65) Prior Publication Data

US 2021/0380292 A1 Dec. 9, 2021

(30) Foreign Application Priority Data

Oct. 19, 2018 (FR) ..... 1871221

(51) Int. Cl.
*B65B 5/06* (2006.01)
*B65B 35/30* (2006.01)

(52) U.S. Cl.
CPC ..... *B65B 35/30* (2013.01); *B65B 5/06* (2013.01); *B65B 2220/14* (2013.01)

(58) Field of Classification Search
USPC ..... 53/443
See application file for complete search history.

(56) References Cited

U.S. PATENT DOCUMENTS

2008/0053039 A1* 3/2008 Vissers ..... B65B 5/06 53/247
2011/0232228 A1* 9/2011 Iwasa ..... B65B 5/061 53/147
2014/0083062 A1* 3/2014 Arimatsu ..... B65B 35/56 53/564
2018/0016043 A1* 1/2018 Yokota ..... B65B 5/06
2021/0261281 A1* 8/2021 Engleman ..... B65B 11/004

FOREIGN PATENT DOCUMENTS

EP 3118125 A1 1/2017
FR 1418964 A 11/1965
GB 1243727 A 8/1971
GB 2196596 A 5/1988

OTHER PUBLICATIONS

International Search Report of International Application No. PCT/EP2019/078292 dated Mar. 13, 2020 (4 pages).

* cited by examiner

*Primary Examiner* — Chinyere J Rushing-Tucker
(74) *Attorney, Agent, or Firm* — Lippes Mathias LLP

(57) ABSTRACT

A device for collating and loading articles includes a container which is open along its upper wall and has a front wall which is adjacent to two side walls and a lower wall. One of these walls is movable and designed for loading the articles into a case. A variable-geometry means is provided for collating articles in the direction of a reference point zero (0), in the plane of the lower wall, in the orthonormal directions 0X and 0Y. The articles are intended to change and amend their trajectories in the orthonormal directions 0X and 0Y towards the reference point (0), depending on the amount of space they occupy.

8 Claims, 5 Drawing Sheets

[Fig. 1]
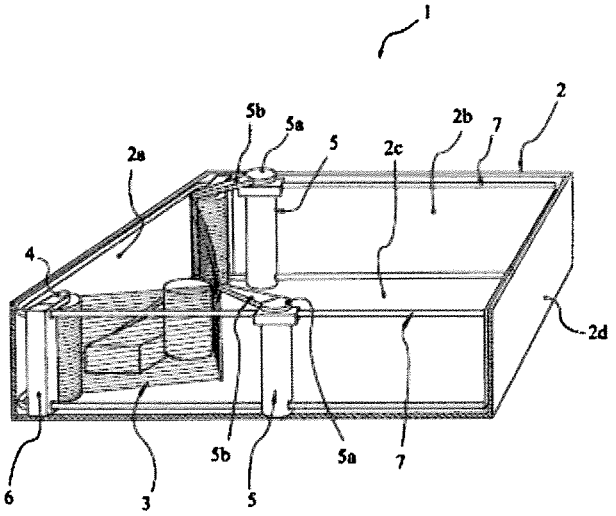
[Fig. 2]
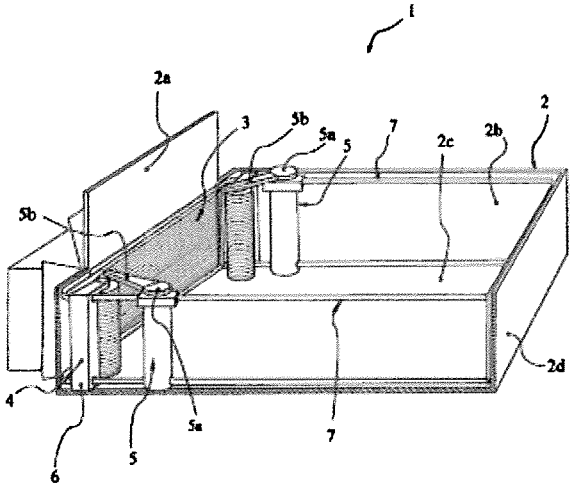

[Fig. 3]
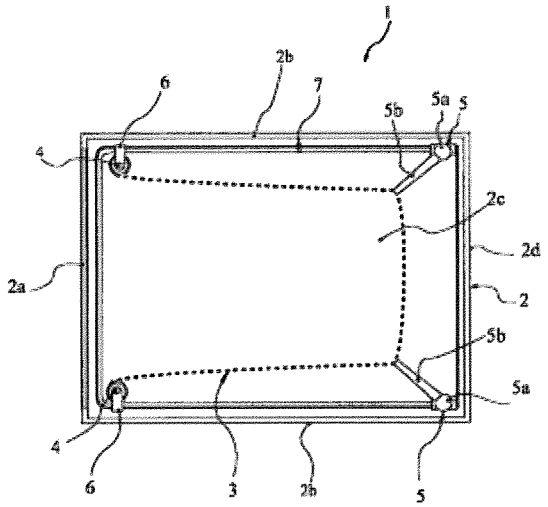
[Fig. 4]
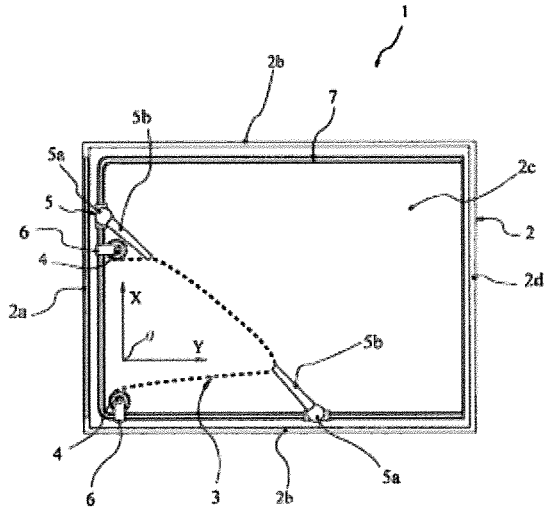

[Fig. 5]
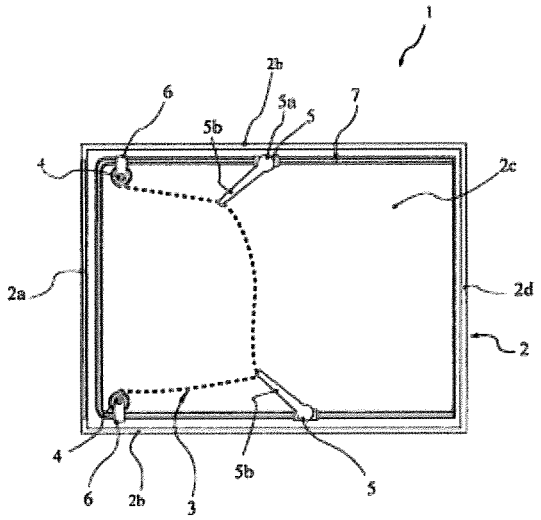
[Fig. 6]
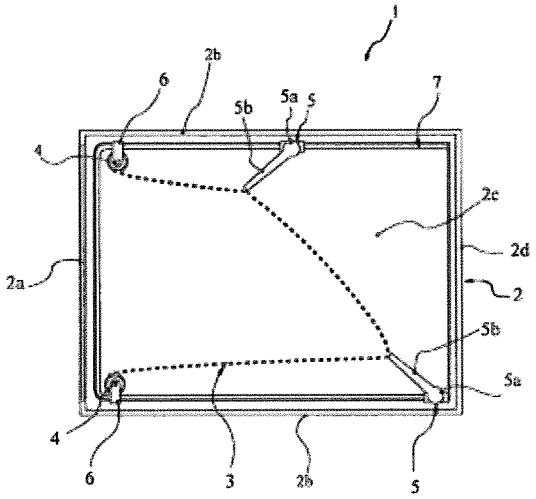

[Fig. 7]
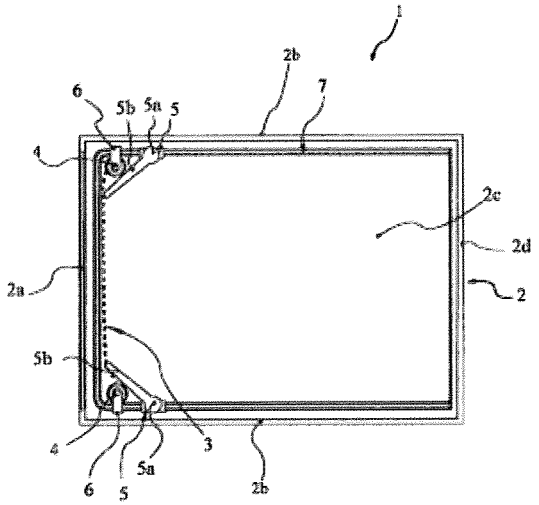
[Fig. 8]
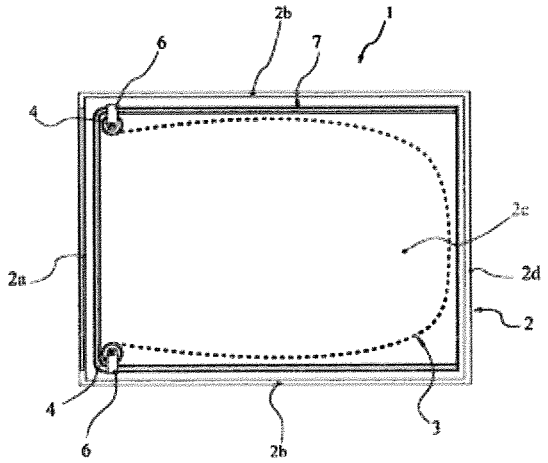

[Fig. 9]
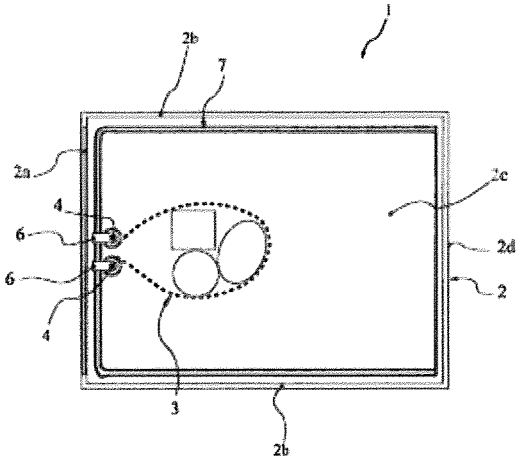
[Fig. 10]
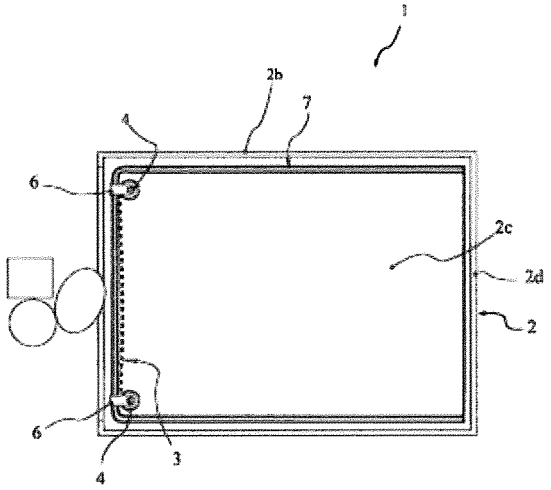

DEVICE AND METHOD FOR COLLATING AND LOADING ARTICLES

BACKGROUND OF THE DISCLOSURE

This application is the entry into the U.S. national phase of International Application No. PCT/EP2019/078292 which was filed on Oct. 17, 2019. That application in turn claims priority from French Patent Application No. 1871221 which was filed on Oct. 19, 2018.

The present disclosure relates to a device for collating and discharging articles in a case, as well as the implementation method thereof.

Usually, the articles to be packed in a case are positioned manually by an operator.

In view of the placement into the case, the operator determines the size of the case to use, either by way of an approximate determination of the volume of the articles to be packaged, or on the basis of information communicated to them by a control center which informs them of the size of the case to be selected according to the volume of their order.

This latter option facilitates the operators' task, optimizes the sizes of the case according to the overall order volume, and improves the productivity. This prior determination of the size of the cases to be used does not solve the problem that, depending on the different volumes of articles, the operator must determine the organization of the articles to be packed according to their volume, in a case which has been selected by the control center according to the overall volume of articles to be packed.

It is also known to automatically pack a specified number of packets, of the same size and of parallelepipedic shape, in a case, by means of a gripper, in order to form layers of packing formed of a predetermined number of articles according to a predetermined arrangement.

Packing systems are also very widespread which make it possible to optimize the arrangement of packets of parallelepipedic shape but different volumes, in a case or on a pallet, by means of a gripper, which will select, according to the different logical possibilities, a particular arrangement that makes it possible to position a maximum number of packages in the final container.

However, the use of a gripper is limited to articles of regular shapes, and is generally not suitable for articles sold in particular via e-commerce platforms, which may be of shapes and dimensions which vary greatly from one article to another.

Recently, online sales platforms for foodstuffs which are delivered via current postal channels have been developed. These foodstuffs have an even greater variety in shape and volume, which cannot be handled by the conventional automatic packaging systems. These foodstuffs also have a level of fragility that requires particular handling precautions.

The sum of the volumes of articles of an order, which includes consumer goods or foodstuffs, can, on account of the sum of the above-mentioned volumes, correspond to a volume of a selected case only if the articles are arranged manually by a conscientious operator, which represents a non-negligible achievement, in particular at the rates required, due to the significant number of daily orders.

It appears that the only reasonable option for overcoming the above-mentioned disadvantages is that of selecting a large case, whatever the type of order, which then requires a significant quantity of wedging and padding elements. The systematic use of large cases and a significant number of padding elements does not appear to be a reasonable and viable solution that meets the real needs of e-commerce platforms.

Given the huge volume of orders on the above-mentioned platforms, there is a growing wish to automate the packaging steps.

The present disclosure is directed to a device for collating and discharging articles which makes it possible to select a case size with respect to the volume of articles of an order which are previously collated and are intended to be discharged into a case, which device makes it possible to overcome the above-mentioned disadvantages and others while providing a better overall result.

SUMMARY OF THE DISCLOSURE

Thus, the device for collating and discharging articles according to the present disclosure includes a container, open on the upper wall thereof, having a front wall, adjacent to two side walls, and a lower wall, of which one of the walls is movable and intended for discharging articles into a case, as well as a means for collating articles in the direction of a reference point zero in the plane of the lower wall, in the orthonormal directions 0X and 0Y.

According to one embodiment of the disclosure, the collating means has a variable geometry means, the articles being intended to change and amend their trajectories in the orthonormal directions 0X and 0Y towards the reference point zero, depending on the respective amounts of space they occupy.

According to another embodiment of the disclosure, the collating means includes a flexible strip.

According to another aspect of the disclosure, at least one end of the flexible strip is connected to a winding means of the flexible strip.

According to another aspect of the disclosure, the flexible strip is guided along at least the side walls, freely connected by guide means that are movable in translation along at least the side walls.

According to another aspect of the disclosure, the winding means is movable at least along the front wall.

According to another embodiment of the disclosure, the winding means is a torque-controlled motor.

According to another embodiment of the disclosure, each of the ends of the flexible strip is connected to a winding means.

According to another aspect of the disclosure, the guide means are linear motors.

According to another embodiment of the disclosure, the movable wall is the front wall.

According to another aspect of the disclosure, the lower wall includes a drive means that is intended to contribute to the movement of articles.

In accordance with another embodiment of the disclosure, a method for collating and discharging articles includes the following steps:

- randomly positioning articles in a container, open on the upper wall thereof, having a front wall, adjacent to two side walls, and a lower wall, of which one of the walls is movable, and the container has a flexible strip,
- collating articles at a reference point zero, by winding the flexible strip connected at at least one of the ends thereof, to a winding means,
- determining the dimension occupied by the articles collated by the flexible strip,
- determining a case dimension corresponding to the dimension occupied by the collated articles, positioning the case opposite the movable wall, opening the movable wall, taking up the winding of the flexible strip, in such a way as to discharge the articles from the container towards the case.

Still other features and aspects of the disclosure will become clear from the following description, with reference to the accompanying drawings which are given merely by way of non-limiting example.

BRIEF DESCRIPTION OF THE DRAWINGS

FIG. 1 is a perspective view of a device for collating and discharging articles in accordance with an embodiment of the disclosure in an article collating position.

FIG. 2 is a perspective view of the device for collating and discharging articles in an article discharging position.

FIG. 3 is a bottom elevational view of the device for collating and discharging articles in a position awaiting loading.

FIG. 4 is a bottom elevational view of the device for collating and discharging articles of FIG. 1.

FIG. 5 is a bottom elevational view of the device in a second article collating position.

FIG. 6 is a bottom elevational view of the device in a third article collating position.

FIG. 7 is a bottom elevational view of the device of FIG. 2.

FIG. 8 is a bottom elevational view of a device for collating and discharging articles according to another embodiment of the disclosure in a position awaiting loading.

FIG. 9 is a bottom elevational view of the device in an article collating position.

FIG. 10 is a bottom elevational view of the device of FIG. 2 in an article discharging position.

DETAILED DESCRIPTION OF THE DISCLOSURE

Thus, referring to FIGS. 1-10, a device (1) for collating and loading and discharging articles, according to the present disclosure, includes a container (2) having a movable wall and equipped with a means for collating articles in the direction of a reference point zero (0).

The device (1) according to the disclosure allows for the discharge of articles into a case, the dimensioning of which is determined by the volume of articles collated by the collating means.

The container (2) is open on the upper wall thereof, in order that articles can be deposited in a random manner, in the interior space thereof.

Preferably, the heaviest articles are positioned in a random manner, downstream of the interior space of the container (2), while the lighter articles, or indeed the more fragile articles, are advantageously positioned upstream of the interior space, with respect to the reference point zero (0).

It will be noted that the articles may be of any size, any shape, stiff or fragile, as long as the dimensioning thereof is suitable for the interior space of the container (2).

It will be specified that the container (2) includes a front wall (2*a*), two side walls (2*b*), a lower wall (2*c*), and advantageously a rear wall (2*d*), of which at least one of the walls of the container (2) is movable and intended for discharging articles into a case.

The term "case" (C) is used generally, in this description, to describe a receptacle, a box, or a container, in which at least one article is packed.

According to the embodiment of the disclosure shown, the movable wall is the front wall (2*a*).

According to the preceding embodiment, as shown in FIG. 1, a case is arranged opposite the front wall (2*a*) of the container (2), the opening thereof, for example by sliding upwards, allows for the discharge of articles into the case by the collating means, as specified in more detail in the remainder of the description.

According to another embodiment (not shown), the movable wall is the lower wall (2*c*); a case is arranged below the lower wall (2*c*), the opening thereof, for example by sliding laterally, allows for the discharge of articles into the case, optionally assisted by the collating means.

The device (1) according to the present disclosure allows for two operational phases to be carried out, i.e. a first phase of collating articles, and a second phase of discharge.

The first phase of collating articles is conducted in the direction of a reference point zero (0), in which the movable wall is closed, i.e. blocks the interior space of the container (2), the articles being intended to be positioned in such a manner that it is stressed preferably against the front wall (2*a*) and advantageously against at least one side wall (2*b*).

The second phase of discharge includes opening the movable wall, the articles being intended to be conveyed outside the container (2) towards the inside of a case by the collating means, advantageously assisted by a drive means, as explained in greater detail in the remainder of the description.

It should be added that the collating means is intended to direct the articles from a random position within the inside space of the container (2) in the direction of a reference point zero (0), for example one of the corners of the container (2), formed by the junction of the front wall (2*a*) and one of the side walls (2*b*), or the center of the front wall (2*a*).

This collating is carried out in the plane of the lower wall (2*c*), in the orthonormal directions 0X and 0Y.

According to a preferred aspect of the disclosure, the collating means is of variable geometry, i.e. the articles are intended to change and amend their trajectories all along the path thereof, from their random loading position to their collating position, in the direction of the zero reference point (0), depending on the respective dimensioning thereof and the design variation of the collating means.

According to the embodiment shown, the collating means has a flexible strip (3) which is advantageously guided along at least the side walls (2*b*) of the container (2), and advantageously the front wall (2*a*).

It is understood that the term "flexible strip" (3) includes the usual terms of belt, flexible wall, netting, etc.

The term "flexible" is understood to mean a sufficiently supple material, preferably a non-resilient material.

According to the embodiments shown, in the first phase the device (1) is intended to take on two configurations, i.e. a configuration awaiting loading, in which the flexible strip (3) substantially defines the inside periphery of the container (2), as explained in greater detail in the remainder of the description, and a configuration for collating articles in the direction of a reference point zero (0).

A flexible strip (3) is formed by a parallelogram having a low thickness, thus having four edges, i.e. a lower edge intended to change in the region of the lower wall, an upper edge, and two side edges intended to change in a manner matched to at least the side walls (2*b*) of the container (2), of which the heights of the side edges are advantageously intended to substantially coincide with those of the walls (2*a*, 2*b*, 2*d*) of the container (2). The edges are delimited by two faces, i.e. an inside face intended for collating articles, and an outside face intended for substantially developing or fitting, at least in the article loading position, the side walls (2*b*), or indeed the rear wall (2*d*), of the container (2).

According to the embodiment shown, in the position for loading articles, as shown in FIG. 3, i.e. in the rest position of the device (1), the side edges of the flexible strip (3) substantially coincide with the edges formed by the junction of the side walls (2*b*) and the front wall (2*a*) of the container (2), while, as specified above, the outside face of the flexible strip (3) substantially fits the side walls (2*b*) and advantageously the rear wall (2*d*) of the container (2), the flexible strip (3) substantially defining the inside periphery of the container (2), at least a portion of the inside perimeter of the container (2), i.e. the parts corresponding to the side walls (2*b*) and advantageously the rear wall (2*c*).

It should be noted that at least one of the side ends of the flexible strip (3), i.e. at least one of the side edges, is connected to a traction means of the flexible strip (3), preferably each of the side edges is connected to a traction means.

According to the embodiment shown, the traction means of the flexible strip (3) is a winding means (4).

A winding means (4) of the flexible strip (3), according to the embodiment shown, is formed by a motor, advantageously torque-controlled.

It should be specified that the axis of rotation of the above-mentioned motor is arranged perpendicularly to the lower wall (2*c*) of the container (2), i.e. in parallel with the edges formed by the intersections of the front wall (2*a*) and the side walls (2*b*) of the container (2).

According to a preferred embodiment of the disclosure, the winding means (4) is a torque-controlled motor, intended to stop the winding of the flexible strip (3) when a specified stress value is reached, in order to avoid damaging the articles during the collating in the direction of the reference point zero (0).

According to one aspect of the disclosure, which is shown in particular in FIGS. 4 to 6, the winding of the flexible strip (3) is achieved by the outside of the winding means (4).

According to another aspect of the disclosure, at least one of the winding means (4) is movable in translation along at least the front wall (2*a*), or indeed also a side wall (2*b*).

Thus, according to the embodiment shown, a winding means (4) is associated with a translation means (6) for translation along one of the walls (2*a*, 2*b*) of the container (2).

According to an aspect of the disclosure, the translation means (6) of the drive means (4) is a linear motor.

It is understood that a linear motor is a motor intended to subject an element to a translation along a specified path.

For this purpose, the upper edges of the container (2) comprise guides (7), such as slides or guide tubes intended for movements of the translation means (6), the winding means (4), and advantageously the guide means (5), as specified in greater detail in the remainder of the description, by suitable rolling means.

It should be noted that the above-mentioned guides (7) extend at least from the rear wall (2*d*), along the side walls (2*b*), and are extended by a curve towards the front wall (2*a*), allowing the collating means to develop the side walls (2*b*) to the front wall (2*a*) and vice versa.

According to additional aspects of the disclosure, the lower edges of the container (2) also include guides (7) as specified above, the winding means (4) and advantageously the guide means (5) being doubled up in opposition with respect to the flexible strip (3).

By way of example, at each of the ends of the flexible strip (3), i.e. at each of the side edges of the flexible strip (3), two winding means (4) are fixed in opposition, and advantageously as many guide means (5) as necessary, in the region of the upper and lower edges of the flexible strip (3).

According to an embodiment, shown in FIGS. 1 to 7, the container (2) has at least one guide means (5) of the flexible strip (3) which is intended to change along at least one side wall (2) and advantageously along the front wall (2*a*) of the container (2).

According to the embodiment shown, the guide means (5) are connected to a wall (2*a*, 2*b*) of the container (2) and are movable in translation, at least along the wall (2*a*, 2*b*) to which the guide means (5) is connected.

A guide means (5) retains the flexible strip (3) in the region of the connection thereof to the guide means (5), along the wall (2*a*, 2*b*) to which the guide means (5) is connected.

According to one embodiment, as shown in particular in FIGS. 1 and 2, a guide means (5) is provided by a first connection part (5*a*) for connection to the above-mentioned guide (7), which is movable in a sliding manner and extended by a second connection part (5*b*) for connection to the flexible strip (3), the second part (5*b*) being connected by an articulation to the first connection part (5*a*), but it could be different, the second connection part (5*b*) being flexible.

According to the above embodiment, the second connection part (5*b*), connected by an articulation to the first part (5*a*), makes it possible that, in the discharge position, as explained in greater detail in the remainder of the description, the flexible strip (3) is in parallel with and closest to the front wall (2*a*), as shown in FIG. 2, in order to allow for the ejection of articles outside of the container (2).

According to one embodiment of the disclosure, the guide means (5) of the flexible strip (3) are borne by a second set of guides arranged above the guides (7) of at least one winding means (4). This configuration also makes it possible that, in the discharge position, the flexible strip (3) may be positioned in parallel with and closest to the front wall (2*a*).

It should be noted that the flexible strip (3) is freely displaceable in the guide means (5).

The traction of the flexible strip (3) achieved by the winding means (4) which is connected to one of the ends thereof, winds the flexible strip (3) around said winding means and thus drives the guide means (5) along the corresponding wall (2*a*, 2*b*).

It is noted that, since the flexible strip (3) is pulled, under stress, in the winding means (4), the flexible strip (3) slides in the guide means (5) and causes this to move in the direction of the reference point zero (0).

It is understood that the movements of the flexible strip (3), the winding means (4), and the guide means (5) are limited by the articles to be collated.

According to one embodiment of the disclosure, the guide means (5) is a passive system which is movable according to the traction of the flexible strip (3).

According to the preceding embodiment, the device (1) is returned to the rest position, i.e. into a position of loading of the container (2), by a return means.

According to one embodiment (not shown), a return means is a cable fixed to the rear surface of the flexible strip (3), driven by a winding means located in the region of the rear wall (2*d*) of the container (2). Bringing into operation the return means, in the discharge position of the container (2), brings about the unwinding of the flexible strip (3) as far as the inside periphery of the container (2).

According to a preferred embodiment, the guide means (5) is a system which is actively movable, such as a linear motor.

According to the preceding embodiment, in the operating mode of the collating means, the guide means (5) is passive and is driven in translation by the traction of the flexible strip (3), but the situation could be different in that the linear motor is brought into operation in order to contribute to the movement of the flexible strip (3) in order to collate the articles in the direction of the reference point zero (0), while the return to the rest position of the device (1) is achieved by bringing into operation the guide means (5) in order to reposition the flexible strip (3) in the rest position of the device (1), awaiting loading.

It should be specified that the repositioning of the flexible strip (3) towards the inside periphery of the container (2) is achieved by the traction thereof, by the translation of the guide means (5) along the guides (7).

According to the preceding embodiment, an active guide means (5) allows for an increased loading and discharge rate of the articles.

According to another embodiment, as shown in FIGS. 8 to 10, the device (1) does not comprise any guide means (5) of the flexible strip (3).

According to the preceding embodiment, the flexible strip (3) is sufficiently rigid for the unwinding of the flexible strip (3) by the winding means (4) to allow for the flexible strip (3) to return to its loading waiting position, i.e. for the flexible strip (3) to be able to substantially adopt the inside periphery of the container (2).

According to another embodiment of the disclosure, the device (1), which does not have any guide means (5), further has a return means for the flexible strip (3), as specified above, which contributes to returning the device (1) into the rest position waiting for loading.

According to another aspect of the disclosure, the lower wall (2*c*) is provided with a drive means (not shown) which is intended to contribute to the movement of articles in the direction of the front wall (2*a*) in order to facilitate the collating of articles in the direction of the reference point zero (0) and contribute to the discharge of articles when one of the walls (2*a*, 2*c*) of the container (2) is open opposite a case.

According to the preceding embodiment, the drive means is a belt or roller conveyor which drives the articles in a unidirectional manner towards the front wall (2*a*) of the container (2).

According to the embodiment shown in FIGS. 1 to 7, the device (1) has two winding means (4), which are each arranged at the ends of the flexible strip (3), and two guide means (5).

According to the preceding embodiment, at least one of the winding means (4) is movable in translation along the front wall (2*a*), and advantageously also along a side wall (2*b*).

According to another embodiment, one of the two winding means (4) is movable in translation along at least the front wall (2*a*), while the other is fixed in translation and located at the intersection of the front wall (2*a*) with one of the side walls (2*b*).

According to one embodiment (not shown), the device (1) has a winding means (4) which is movable in translation, and two guide means (5), while one end of the flexible strip (3) is fixed to one of the intersections of the front wall (2*a*) and one of the side walls (2*b*).

According to another embodiment (not shown), the device (1) has a winding means (4) which is fixed to one of the intersections of the front wall (2*a*) and one of the side walls (2*b*), while the other end of the flexible strip (3) is connected to an active guide means (5).

According to the embodiment of the disclosure shown in FIGS. 8 to 10, the device (1) includes two winding means (4) which are each arranged at the ends of the flexible strip (3).

According to the preceding embodiment, the winding means (4) are movable in translation along the front wall (2*a*), and advantageously also along a side wall (2*b*).

It should also be noted that the device (1) includes a unit for measuring and processing the spacings of the various elements forming it.

It should be noted that the device (1) is intended to determine a case size corresponding to the space occupied by the articles collated in the direction of the reference point zero (0).

It is considered that the dimensions of a case are represented by the width thereof, the length thereof, and the height or depth thereof.

According to an option of the disclosure, the movable wall is the front wall (2*a*); once the articles are collated in the direction of the reference point zero (0), the volume of collated articles is determined as specified in more detail in the remainder of the description. A case, dimensioned in a manner corresponding to the volume of the collated articles, is positioned on one of the blanks thereof, opposite the front wall (2*a*). The front wall is then opened, for discharging the articles into the case.

Thus, the space occupied by the articles collated in the direction of the reference point zero (0) can be determined by the spacing of the two ends of the flexible strip (3) thus corresponding to the length of the case; the largest spacing between an end of the flexible strip (3) and a guide means (5) along a side wall (2*a*) thus corresponds to the height or depth of the case, while the width of the case is determined by the greatest height of the articles to be collated.

It will be noted that a greater height of articles to be collated can be determined by a suitable sensor, typically used in the field of mechatronics, such as a distance sensor.

In order to explain these latter features, reference is made to FIGS. 4 to 6 which schematically show the collating spaces of articles denoted E1, E2, E3, respectively.

In the collating configuration E1, the length of the case is determined by the spacing of the ends of the flexible strip (3), i.e. the spacings of the two winding means (4) along the front wall (2*a*), while the height of the case is determined by the spacing of the end of the flexible strip (3) and the guide means (5), both located on a side wall (2*b*).

It should be noted that, in the configuration E1, a winding means (4) and the guide means (5) arranged in correspondence, are adjacent and are located in the region of the front wall (2*a*), while the second winding means (4) is located at the intersection of the front wall (2*a*) and the side wall (2*b*) arranged in correspondence.

In the collating configurations E2 and E3, the length of the case is determined by the ends of the flexible strip (3) which are located at the intersections of the front face (2*a*) and the side walls (2*b*), while the height of the case is determined by the largest spacing between an end of the flexible strip (3) and a guide means (5), both located on the same side wall (2*b*).

According to another aspect of the disclosure, the movable wall is the lower wall (2*c*); once the articles are collated in the direction of the reference point zero (0), in view of the determination of the volume of the collated articles, a case, dimensioned in a manner corresponding to the volume of collated articles, is positioned below the lower wall (2*c*).

Thus, the height of the case is determined by the greatest height of the articles, the length is determined by the spacing of the ends of the flexible strip (3), and the width of the case is determined by the largest spacing between an end of the flexible strip (3) and a guide means (5), both located on the same side wall (2*b*).

According to another aspect of the disclosure, the dimensions of the case to be positioned are determined by distance sensors, for example located in the region of the side walls (2*b*) and advantageously in the region of the rear wall (2*c*), or indeed in line with the device (1), in order to determine the volume of articles collated by the collating means.

The discharge of articles into a case is achieved by blocking the winding means (4) in translation, the tensioning of the flexible strip (3), and the maximum winding of the flexible strip (3), which drives the articles into the case via the open wall of the container (2), optionally assisted by the drive means.

It should be specified that, in view of the discharge of articles outside the container (2), the flexible strip (3) is wound until it is stretched between the winding means (4) or between a winding means (4) and a junction of the front wall (2*a*) and a side wall (2*b*), arranged opposite the winding means (4) mentioned above.

Bringing the device (1) according to the disclosure into operation will be explained in greater detail in the following, by way of the method for implementing the device (1) according to the invention.

Thus, the disclosure also relates to a method for collating and discharging articles by means of a device (1) comprising a container (2), open on the upper wall thereof, comprising a front wall (2*a*), adjacent to two side walls (2*b*), and a lower wall (2*c*), of which one of the walls is movable, intended for discharging articles into a case.

It should be noted that the device (1) has a flexible strip (3) that is connected, at at least one of the lateral ends thereof, to a winding means (4) guided along at least the front wall (2*a*).

It should be specified that the flexible strip (3) may at least adopt two positions, i.e. a position awaiting loading, the flexible strip (3) being located substantially at the inside periphery of the container (2), and a position for collating articles, in which the lateral ends thereof are located along the front wall (2*a*), the articles being collated in a manner stressed against the inside surface thereof.

In accordance with another aspect of the disclosure, a method for collating and discharging articles includes the following steps:

1)—placing the device (1) in a position awaiting loading, in which the flexible strip (3) is located substantially at the inside periphery of the container (2), i.e. along the side walls (2*b*) and advantageously along the rear wall (2*d*), the lateral ends thereof advantageously being positioned in the region of the front wall (2*a*) of the container (2), 2)—loading articles, advantageously in a random manner, into the inside periphery of the flexible strip (3), 3)—bringing into operation the winding means (4) in order to collate the articles in the direction of a reference point zero (0), the articles being placed under stress against the inside surface of the flexible strip (3), 4)—opening the movable wall of the container (2), and 5)—bringing into operation the winding means (4) in order to stretch the flexible strip (3) and to discharge the articles in the direction of the open wall of the container (2), According to another embodiment of the disclosure, the movable wall is the front wall (2*a*), the lateral ends of the flexible strip (3) being positioned along the front wall (2*a*) prior to the movable front wall (2*a*) being opened.

According to still another embodiment of the disclosure, the movable wall is the lower wall (2*c*).

According to an intermediate step, prior to opening the movable wall a case is positioned opposite the movable wall, the dimensions of the case being selected depending on the volume of articles collated by the flexible strip (3).

The exemplary embodiment has been described with reference to the preferred embodiments. Obviously, modifications and alterations will occur to other upon a reading and understanding of the preceding detailed description. It is intended that the appended claims be construed as including all such modifications and alterations insofar as they come within the scope of the embodiments of the equivalents thereof.

The invention claimed is:

1. A device for collating and discharging articles, comprising:

a container having an upper wall with an opening therein, comprising a front wall, adjacent to two side walls, and a lower wall, of which one of the front wall, two side walls, and lower wall is movable and intended for discharging articles into a case;

a variable-geometry means for collating articles in the direction of a reference point zero (0), in the plane of the lower wall, in the orthonormal directions 0X and 0Y, the variable-geometry means being able to change and amend the trajectories of the articles in the orthonormal directions 0X and 0Y towards the reference point (0), depending on the amount of space they occupy;

wherein a collating means comprises a flexible strip;

wherein at least one end of the flexible strip is connected to a winding means of the flexible strip;

wherein the flexible strip is guided along at least the side walls, freely connected by a guide means that is movable in translation along at least the side walls; and, wherein the winding means is movable at least along the front wall.

2. The device according to claim 1, wherein the winding means is a torque-controlled motor.

3. A device for collating and discharging articles, comprising:

a container, having an upper wall with an opening therein, comprising a front wall, adjacent to two side walls, and a lower wall, of which one of the front wall, two side walls, and lower wall is movable and intended for discharging articles into a case; and a variable-geometry means for collating articles in the direction of a reference point zero (0), in the plane of the lower wall, in the orthonormal directions 0X and 0Y, the variable-geometry means being able to change and amend trajectories of the articles in the orthonormal directions 0X and 0Y towards the reference point (0), depending on the amount of space they occupy, wherein a collating means comprises a flexible strip, wherein each end of the flexible strip is connected to a winding means of the flexible strip.

4. The device according to claim 3, wherein the flexible strip is guided along at least the side walls, freely connected by a guide means that are is movable in translation along at least the side walls.

5. The device according to claim 4, wherein the guide means are linear motors.

6. The device according to claim 3, wherein the movable wall is the front wall.

7. The device according to claim 3, wherein the lower wall comprises a drive means that is intended to contribute to the movement of articles.

8. A method for collating and discharging articles, comprising the following steps:

randomly positioning articles in a container, having an upper wall with an opening, comprising a front wall, adjacent to two side walls, and a lower wall, of which one of the front wall, two side walls, and a lower wall is movable, said container comprising a flexible strip connected at least one of the ends thereof to a winding means;

determining the dimension occupied by the articles collated by the flexible strip;

determining a case dimension corresponding to the dimension occupied by the collated articles;

positioning the case opposite the movable wall;

opening the movable wall; and winding of the flexible strip, in such a way as to discharge the articles from the container towards the case.

* * * * *